United States Patent [19]

Wada et al.

[11] Patent Number: 4,615,105

[45] Date of Patent: Oct. 7, 1986

[54] ELECTROACOUSTIC TRANSDUCER AND A METHOD FOR MANUFACTURING THEREOF

[75] Inventors: Hiroto Wada; Minoru Nishizono, both of Kanagawa, Japan

[73] Assignee: Tokyo Shibaura Denki Kabushiki Kaisha, Japan

[21] Appl. No.: 636,740

[22] Filed: Aug. 1, 1984

Related U.S. Application Data

[62] Division of Ser. No. 499,555, May 31, 1983.

[30] Foreign Application Priority Data

May 29, 1982 [JP] Japan ..... 57-92017
May 29, 1982 [JP] Japan ..... 57-92018
May 29, 1983 [JP] Japan ..... 57-92023

[51] Int. Cl.[4] ..... H04R 31/00

[52] U.S. Cl. ..... 29/594; 29/847; 156/656; 156/659.1

[58] Field of Search ..... 29/594, 25.41, 825, 29/846, 847; 156/656, 659.1; 179/111 R, 111 E, 115.5 PV, 115 R, 121 R, 138, 140; 361/283

[56] References Cited

U.S. PATENT DOCUMENTS 3,108,162 10/1963 Schindler ..... 29/25.41
3,946,422 3/1976 Yagi et al. ..... 179/111 E

OTHER PUBLICATIONS

Huard, A. E., and Walker, W. J., "Forming Ceramic Components", IBM Tech. Disclosure Bull., vol. 10, No. 8, Jan. 1968.

*Primary Examiner*—Howard N. Goldberg
*Assistant Examiner*—P. W. Echols
*Attorney, Agent, or Firm*—Finnegan, Henderson, Farabow, Garrett & Dunner

[57] ABSTRACT

An electroacoustic transducer includes a base plate made of insulating material, a stationary electrode formed on one side of the base plate and made of electrically conductive material, an annular support formed on the same side of the base plate and surrounding the stationary electrode, the annular support being made of the same electrically conductive material as the stationary electrode, and an electrically conductive diaphragm applied on the annular support.

5 Claims, 11 Drawing Figures

ELECTROACOUSTIC TRANSDUCER AND A METHOD FOR MANUFACTURING THEREOF

This is a division of application Ser. No. 06/499,555, filed May 31, 1983.

BACKGROUND OF THE INVENTION

This invention relates to an electroacoustic transducer and a method for its manufacture.

Various types of miniature electroacoustic transducers or microphones are known such as the electroacoustic microphone shown in FIGS. 1 and 2 of the drawings, which is provided with an electrically conductive cylindrical casing 10 having an opening 12 for receiving sound waves. Base 14 is disposed in casing 10 and includes a recess 16 on its upper side facing opening 12 and aperture 18 in its center. Stationary electrode 20 is secured in recess 16 of base 14, and includes a plastic film 22 on metal plate 24 which functions as a conventional electret film.

Electrically conductive diaphragm 26 is mounted in parallel with opening 12 and stationary electrode 20, with the periphery of diaphragm 26 clamped between insulation spacer 28 mounted on stationary electrode 20 and electrically conductive ring 30 secured to the inner wall of casing 10. Diaphragm 26 is made, for example, of a metal film or a plastic film coated with a metal film and having a thickness of several microns. Metal plate 24 of stationary electrode 20 has protruding pin 32 on its under side to penetrate through hole 18. Protruding pin 32 and casing 10 function as as signal output terminals which is coupled to the desired circuit (not shown).

The electroacoustic microphone shown in FIGS. 1 and 2 is a rather complicated structure and presents problems from the standpoint of its operational characteristics, cost, size, and manufacturing process.

SUMMARY OF THE INVENTION

It is an object of the present invention to provide an improved electroacoustic transducer having a less complicated structure compared to the prior art.

Another object of the present invention is to provide an electroacoustic transducer with improved operational characteristics.

A further object of the present invention is to provide an electroacoustic transducer which is relatively inexpensive.

A still further object of the present invention is to provide an electroacoustic transducer which is relatively easy to manufacture.

Another object of the present invention is to provide an electroacoustic transducer which can be miniaturized.

A further object of the present invention is to provide an improved method for manufacturing an electroacoustic transducer.

According to the present invention, the electroacoustic transducer comprises a base plate made of an insulating material, a stationary electrode plate formed on one side of the base plate and made of an electrically conductive material, an annular support formed on the same side of the base plate and surrounding the stationary electrode plate and made of an electrically conductive material as the stationary electrode plate, and an electrically conductive diaphragm secured on the annular support and which defines an air gap with the stationary electrode plate.

Further, the method for manufacturing the electroacoustic transducer in accordance with the invention comprises the steps of providing an insulating base plate with at least a layer of electrically conductive material applied on one side of the base plate, forming a stationary electrode plate and an annular support surrounding the stationary electrode plate on said one side of the base plate by selectively removing the electrically conductive layer within areas on the base plate to leave the stationary electrode plate and the annular support, thinning the stationary electrode plate more than the annular support and thereafter applying an electrically conductive diaphragm on the annular support.

Additional objects and advantages of the present invention will be apparent to persons skilled in the art from a study of the following description and the accompanying drawings, which are hereby incorporated in and constitute a part of this specification.

DESCRIPTION OF THE PREFERRED EMBODIMENT

Figure 1:
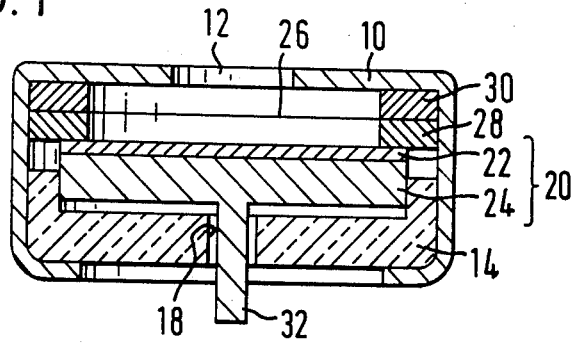
FIG. 1 PRIOR ART
FIG. 1 is a cross-sectional view showing one example of a prior art electroacoustic microphone.
Figure 2:
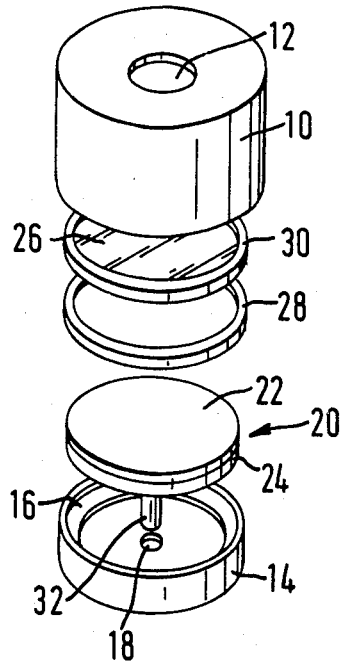
FIG. 2 PRIOR ART
FIG. 2 is an exploded view showing the electroacoustic microphone of FIG. 1.

The present invention will be now described in detail with reference to FIGS. 3 to 8. Throughout the drawings, like reference numerals or letters are used to designate like or equivalent elements.

Figure 3:
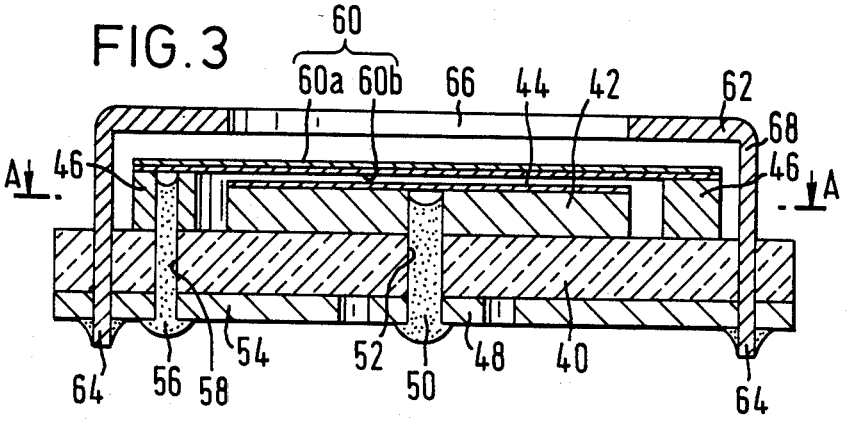
FIG. 3 is a cross-sectional view showing a preferred embodiment of the electroacoustic transducer according to the present invention.
Figure 4:
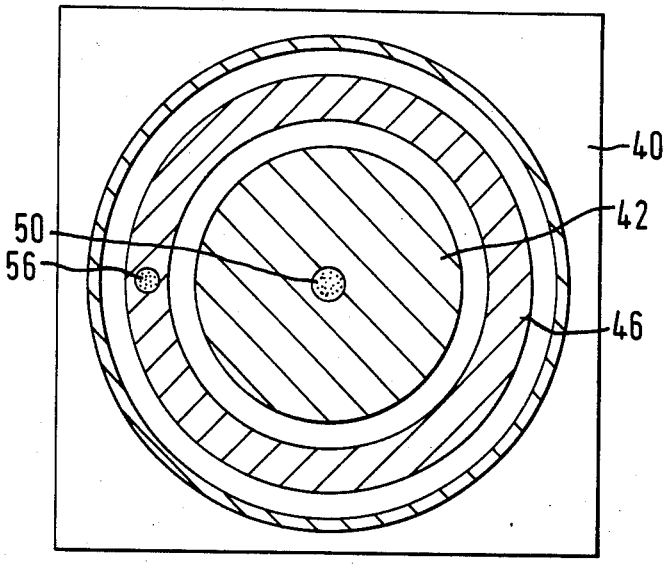
FIG. 4 is a cross-sectional view of the electroacoustic transducer shown in FIG. 3 taken along Section lines A—A.

Referring first to FIGS. 3 and 4, a description will be provided of an electroacoustic transducer embodying the present invention. In FIGS. 3 and 4, base plate 40 is made of an insulating material such as fiberglass. Stationary electrode 42 made of an electrically conductive material such as copper is secured on one side of base plate 40. Base plate 40 has a thickness of about 1 millimeter, and stationary electrode 42 has a thickness of less than 1 milimeter and a diameter of about 4.5 to 8.5 millimeters.

Electret film 44 is secured on the top of stationary electrode 42, and has the same diameter as stationary electrode 42 and a thickness of several microns to several tens of microns. Annular support 46 is made of the same electrically conductive material as stationary electrode 42 and is secured on the same side of base plate 40 and surrounding stationary electrode 42. The annular support 46 has an outer diameter of about 6 to 10 millimeters, an inner diameter of about 5 to 9 millimeters, a thickness of about 1 millimeter, and is about several microns to several tens of microns thicker than the total thickness of stationary electrode 42 and electret film 44.

First terminal 48 is made of an electrically conductive material such as copper and is secured on the other side of base plate 40. Stationary electrode 42 and first terminal 48 are electrically connected to each other by first conductor 50 made of electrically conductive paste filled in through-hole 52, passing through stationary electrode 42, base plate 40 and first terminal 48. Second terminal 54 made of the same conductive material as first terminal 48 is also secured on the other side of base plate 40 and confronting annular support 46. Second terminal 54 and annular support 46 are electrically connected to each other by second conductor 56 made of the same electrically conductive paste as first conductor 50, which is filled in through second through hole 58, passing through base plate 40 and second terminal 54 adjacent of the outer periphery of annular support 46. First and second terminals 48 and 54 have the same thickness of about several tens to several hundreds of microns.

Electrically conductive diaphragm 60 having plastic film base 60*a* and metal layer 60*b* coated on plastic film base 60*a* is secured on annular support 46 at the top end. Diaphragm 60 is arranged in parallel with electret film 44 on stationary electrode 42 and forms an air gap having a thickness of about several or several tens of microns with electret film 44. Cylindrical casing 62 made of an electrically conductive material such as copper or aluminum is mounted on base plate 40 and covers annular support 46 and diaphragm 60. Casing 62 has legs 64, which respectively extend downwards from the bottom end of casing 62, passing through base plate 40 and connected to second terminal 54 on the other side of base plate 40. Casing 62 has an opening 66 at its top facing diaphragm 60. Cylindrical wall 68 of casing 62 has a diameter of about 8 to 12 millimeters and a thickness of about several hundreds microns.

Figure 5:
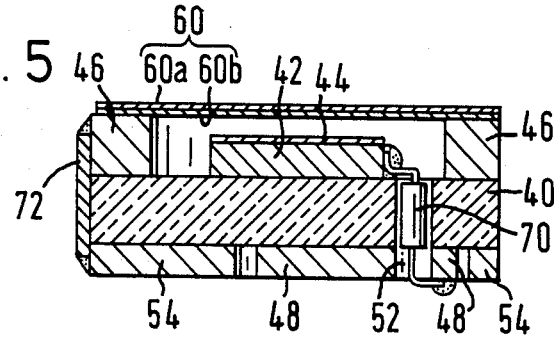
FIG. 5 is a cross-sectional view showing another embodiment according to the present invention.
Figure 6A:
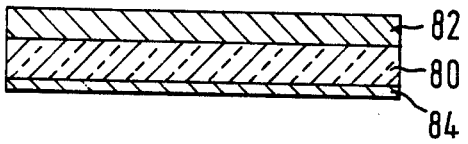
FIGS. 6(*a*)–(*d*) are cross-sectional views showing the steps of manufacturing the electroacoustic transducer shown in FIG. 3.
Figure 6B:
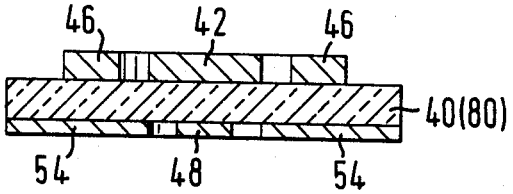
Figure 6C:
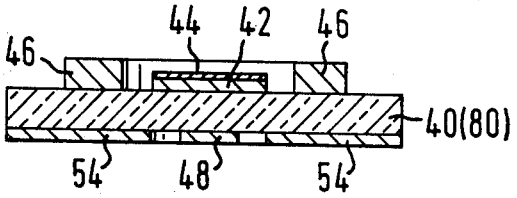
Figure 6D:
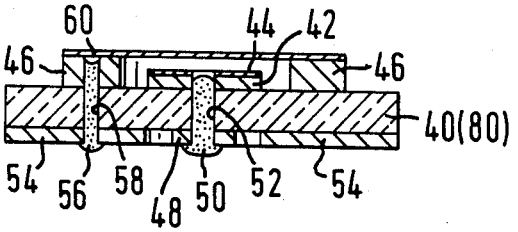

FIG. 5 illustrates another embodiment of the electroacoustic transducer according to the present invention. The modified embodiment shown in FIG. 5 is identical to the first embodiment shown in FIGS. 3 and 4 except that the impedance transforming device 70 is substituted for first conductor 50, and metal plate 72 is substituted for second conductor 56. Impedance transforming device 70 connects annular support 46 and second terminal 54, passing along the periphery of base plate 40. Casing 62 is omitted in this embodiment.

FIG. 6 illustrates the steps for manufacturing the electroacoustic transducer shown in FIGS. 3 and 4. As shown in FIG. 6(*a*), raw material 80 is used as insulating base plate 40, and first and second metal foils or leafs, such as copper foils 82 and 84 are respectively applied to different sides of base plate 40. First metal foil 82 on one side of base plate 40 has the same thickness as annular support 46 shown in FIG. 3. Second metal foil 84 on the other side of base plate 40 has the same thickness as first and second terminals 48 and 54 shown in FIG. 3.

First metal foil 82 is processed in a first etching operation according to conventional techniques to leave only a round disc portion or stationary electrode 42 and an annular portion or annular support 46, as shown in FIG. 3. Second metal foil 84 is also processed in a second similar etching operation to leave only a round disc portion or first terminal 48 and an annular portion or second terminal 54, also shown in FIG. 3. The first and second etching operations can proceed simultaneously or at different times. The areas of the first and second metal foils 82 and 84, except the portions forming stationary electrode 42, annular support 46 and first and second terminals 48 and 54 are then entirely removed.

As shown in FIG. 6(*b*), stationary electrode 42 formed on one side of base plate 40 is again processed in a third etching operation (similar to the first and second etching operations) to decrease its thickness so that it is thinner than annular support 46 by a prescribed dimension of several or several tens of microns. The prescribed dimension can be accurately controlled by regulating the etching operation time or the like.

As shown in FIG. 6(*c*), electret film 44 is applied on stationary electrode 42 after the third etching operation. Electret film 44 is prepared by charging a stable electric charge on a plastic film before or after its application on stationary electrode 42. Although charging of the stable electric charge on the plastic film can be done by various conventional methods, electret film 44 in this embodiment is preferably made in accordance to the method described in U.S. Pat. No. 4,356,049.

As shown in FIG. 6(*d*), first and second through-holes 52 and 58 are defined in base plate 40. First through-hole 52 penetrates electret film 44, stationary electrode 42, base plate 40 and first terminal 48. Second through-hole 58 penetrates annular support 46, base plate 40, and second terminal 54. Then, first and second through-holes 52 and 58 are filled with electrically conductive paste. The paste which forms first conductor 50 (FIG. 3) connects stationary electrode 42 to first terminal 48, and the paste which forms second conductor 56 (FIG. 3) connects annular support 46 to second terminal 54. After the paste fills in first and second through-holes 52 and 58, electrically conductive diaphragm 60 shown in FIG. 3 is applied on annular support 46 at the periphery of diaphragm 60. Diaphragm 60 is arranged in parallel with the electret film 44 formed on stationary electrode 42 and is separated therefrom to maintain the prescribed air gap with electret film 44.

Figure 7:
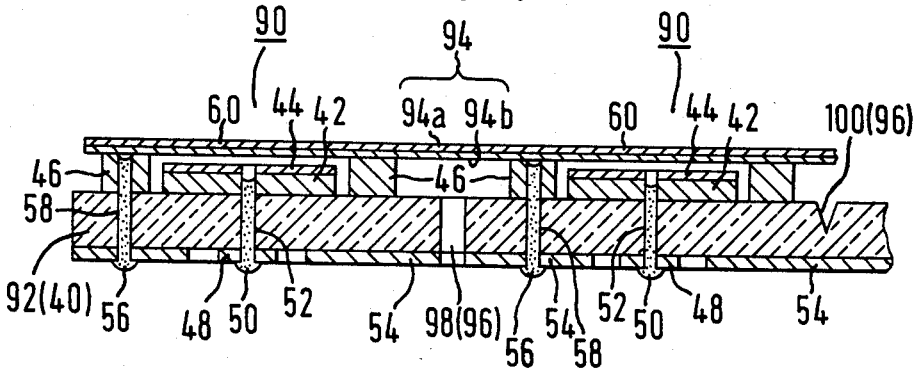
FIG. 7 is a cross-sectional view showing a plurality of electroacoustic transducers manufactured in accordance with one example of the present invention.
Figure 8:
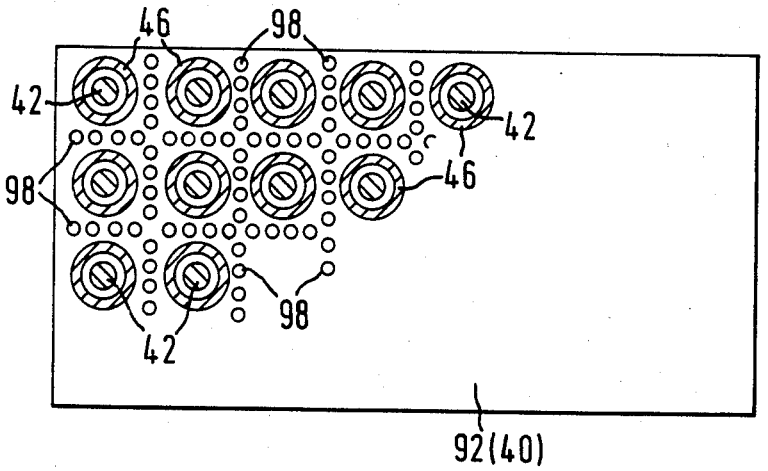
FIG. 8 is a plan view showing the plurality of the electroacoustic transducers of FIG. 7.

Referring now to FIGS. 7 and 8, a modified method from the method illustrated in FIG. 6 for mass production of electroacoustic transducers is described. FIGS. 7 and 8 illustrate only a final step for manufacturing the acoustic transducers according to the present invention. The steps prior to FIGS. 7 and 8 are equivalent to the steps shown in FIG. 6. According to the modified method, a plurality of electroacoustic transducers 90 are formed on a single rectangular wafer 92 made of an insulating material such as fiberglass. Wafer 92 has a plurality of electroacoustic transducer regions or base plates 40 as shown in FIG. 3, aligned lengthwise and crosswise with each other. On every base plate 40, a stationary electrode 42, annular support 46, first and second terminals 48 and 54, etc. are formed in accordance with the steps of FIGS. 6(*a*) to 6(*c*). Then a single rectangular diaphragm sheet 94 having a plastic film base 94*a* and metal layer 94*b* coated thereon is applied across all of the plurality of electroacoustic transducers 90 and is then fixed to the annular ends of the respective annular supports 46. Sheet 94 is then trimmed to leave portions which form diaphragms 60 facing annular supports 46 and stationary electrodes. The electroacoustic transducers 90 are separated from one another by connecting regions 96 of rectangular wafer 92. Connecting regions 96 can comprise perforations 98 (FIG. 8) or V-shape grooves 100 (FIG. 7) which can be easily broken. Perforations 98 and V-shape grooves 100 are able to be made at any time before or after applying diaphragm sheet 94. After manufacture of the plurality of electroacoustic transducer 90 described above, the individual transducers 90 can be separated by breaking connecting regions 96.

While the present invention has been described with reference to particular embodiments thereof, it will be understood by those skilled in the art that numerous modifications can be made without actually departing from the scope of the invention. Accordingly, all modifications and equivalents may be resorted to which fall within the scope of the invention as claimed.

What is claimed is:

1. A method for manufacturing an electroacoustic transducer comprising the steps of:

applying a foil of electrically conductive material to at least one side of an insulating base plate;

forming a stationary electrode and an annular support surrounding the stationary electrode on said at least one side of the insulating base plate, the step comprising selectively removing said electrically conductive foil within areas on said insulating base plate and leaving the stationary electrode and the annular support;

thinning the stationary electrode so that it is less thick than the annular support; and thereafter applying an electrically conductive diaphragm on said annular support facing the stationary electrode.

2. A method according to claim 1, further comprising steps of:

forming a plurality of electroacoustic transducer regions on said at least one side of the insulating base plate, the insulating base plate comprising a single wafer, and separating the elecroacoustic transducer regions from each other by easily breakable connecting regions; and separating said plurality of said electroacoustic transducer regions by breaking the connecting regions; and wherein the forming step comprises a step of forming a plurality of stationary electrodes and annular supports on respective ones of said electroacoustic transducer regions; and the step of applying an electrically conductive diaphragm comprises a step of applying a single sheet of diaphragms on the plurality of said annular supports prior to the separating step.

3. A method according to claim 2, wherein the single wafer of insulating base plate has another foil of electrically conductive material applied on the other side thereof, the method further comprising the steps, prior to the application of said single sheet of diaphragms, of:

forming a plurality of first terminals and second terminals on the other side of the single wafer of insulating base plate within respective electroacoustic transducer regions by selectively removing areas of said electrically conductive foil on the other side of the single wafer of insulating base plate;

defining first and second through-holes within the respective electroacoustic transducer regions, the first through-holes connecting the stationary electrodes and the first terminals in respective electroacoustic transducer regions, and the second through-holes connecting the annular supports and the second terminals in respective electroacoustic transducer regions; and connecting electrically the stationary electrodes and the annular supports respectively to the first and second terminals in respective electroacoustic transducer regions through first and second circuit means respectively passing through the first and second through-holes.

4. A method according to claim 3, wherein the connecting regions have perforations.

5. A method according to claim 3, wherein said connecting regions define V-shape grooves.

* * * * *